United States Patent [19]

Watanabe

[11] 3,961,218

[45] June 1, 1976

[54] SPACER FOR A DISCHARGE DISPLAY DEVICE

[75] Inventor: Satoshi Watanabe, Gyoda, Japan

[73] Assignee: Okaya Denki Sangyo Kabushiki Kaisha, Tokyo, Japan

[22] Filed: Mar. 24, 1975

[21] Appl. No.: 561,299

[30] Foreign Application Priority Data

Mar. 25, 1974 Japan ..... 49-33808[U]

[52] U.S. Cl. ..... 313/220; 313/221

[51] Int. Cl.[2] ..... H01J 61/30

[58] Field of Search ..... 313/220, 188, 221

[56] References Cited

UNITED STATES PATENTS 3,842,308 10/1974 Esdonk et al. ..... 313/188

*Primary Examiner*—R. V. Rolinec
*Assistant Examiner*—Darwin R. Hostetter
*Attorney, Agent, or Firm*—Hill, Gross, Simpson, Van Santen, Steadman, Chiara & Simpson

[57] ABSTRACT

A discharge promotion member for a discharge display device consisting of a conductive plate which is provided with a plurality of apertures therethrough, and an insulating porous layer formed on the surface of the conductive plate. The discharge promotion member is located between a cathode and an anode or the like of the discharge display device in which a glow light discharge is carried out through the aperture of the discharge promotion member by a plasma discharge between the cathode and anode of the discharge display device.

5 Claims, 11 Drawing Figures

SPACER FOR A DISCHARGE DISPLAY DEVICE

BACKGROUND OF THE INVENTION

1. Field of the Invention

This invention relates generally to a discharge promotion member for a discharge display device, and more particularly to a discharge promotion member for a discharge display device which performs a desired pattern of light display by producing a plasma discharge between its cathode and anode. In this case, the member is disposed between the cathode and anode or the like.

2. Description of the Prior Art

In the art, a glass plate, a metal plate covered with an insulating layer or the like has been employed as a spacer in a discharge display tube.

Recently, such a study is carried out that a discharge display device is used in place of a Braun tube for video images. In this case, discharges are produced between a number of cathodes and anodes successively to obtain a predetermined light pattern. Accordingly, it is required that the discharges must be successively produced in accurate order within a predetermined interval of time. Further, a response time interval from the time when a voltage applied to a pair of cathode and anode to the time when a discharge is caused is very important.

SUMMARY OF THE INVENTION

According to an aspect of this invention there is provided a discharge promotion member for a discharge display device which comprises a conductor plate having bored therethrough a plurality of apertures, and an insulating porous layer formed on the surface of said conductive plate, said conductive plate covered with said insulating porous layer being located between a cathode and an anode of a discharge display device in which a glow light display is achieved through the aperture of the discharge promotion member by a plasma discharge between said cathode and anode of the discharge display device.

Accordingly, it is an object of the present invention to provide a novel discharge promotion member.

It is another object of the invention to provide a discharge promotion member for use in a discharge display device.

It is a further object of the invention to provide a discharge promotion member for use in a discharge display device for shortening its response time interval.

The other objects, features and advantages of the invention will become apparent from the following description taken in conjunction with the accompanying drawings.

DESCRIPTION OF THE PREFERRED EMBODIMENT

With reference to the drawings, an embodiment of this invention will hereinafter be described in which this invention is employed as a spacer for a discharge display device.

Figure 1A:
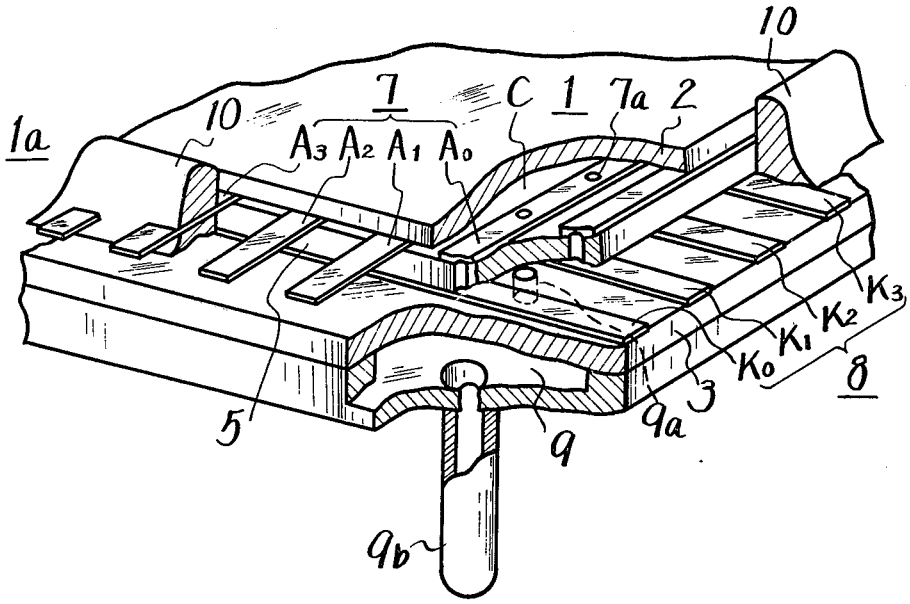
FIG. 1A is a fragmentary perspective view, partly in cross-section, showing a discharge display device employing an embodiment of the discharge promotion member according to this invention.
Figure 1B:
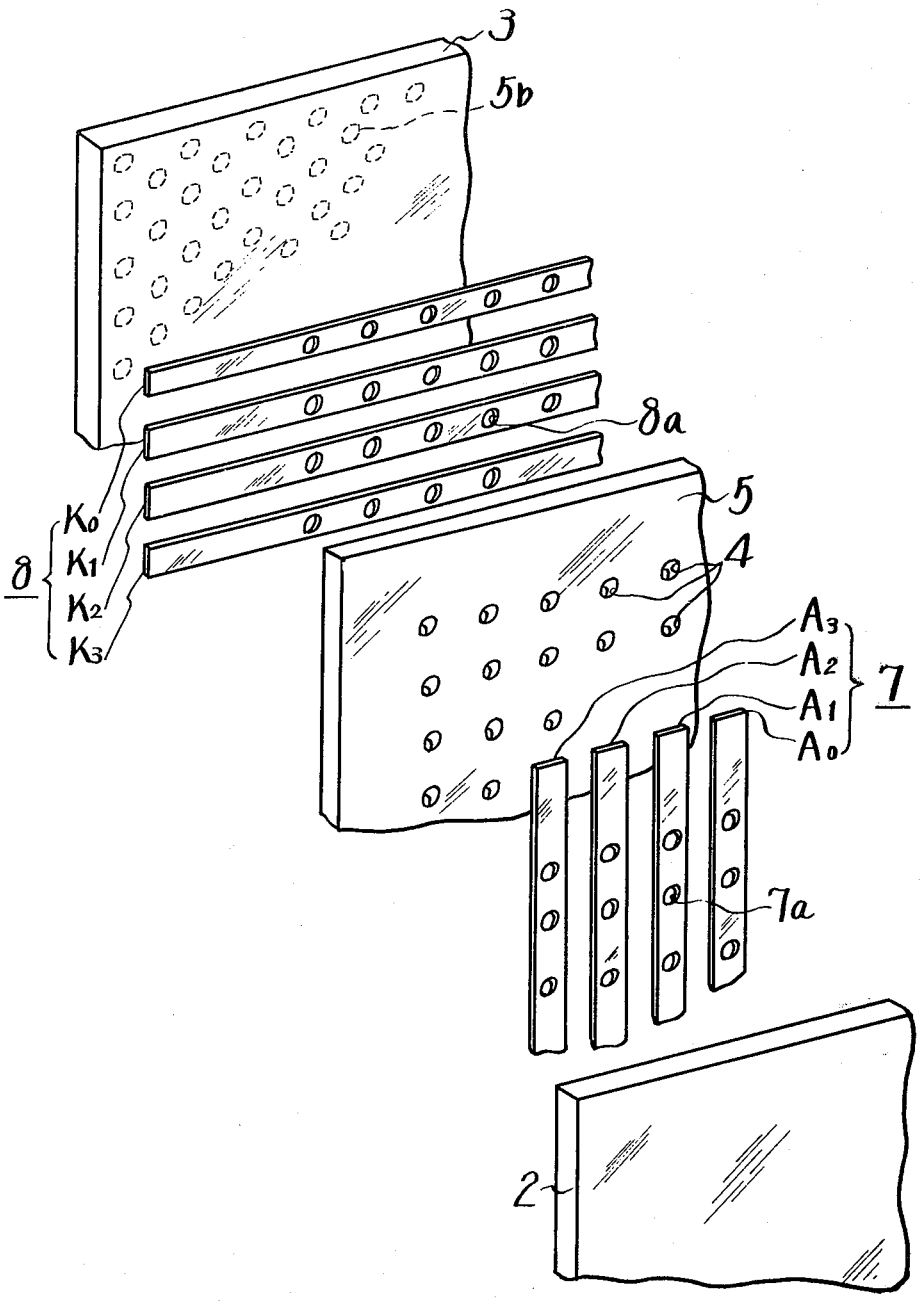
FIG. 1B is an exploded perspective view, partly cut away, showing the principal part of the discharge display device depicted in FIG. 1A.

FIG. 1A is a fragmentary perspective view showing, partly in cross-section, a discharge display device using a discharge promotion member in accordance with one embodiment of this invention. FIG. 1B is an exploded perspective view showing the principal part of the discharge display device examplified in FIG. 1A.

In FIGS. 1A and 1B, reference numeral 1 indicates generally a discharge display device. The discharge display device 1 comprises upper and lower insulating plates 2 and 3 which are disposed in opposing relation to each other and at least one of which is formed of a transparent material such, for example, as glass, and an insulative discharge promotion member 5 of this invention (which will be hereinbelow referred simply to as a spacer) which has bored therethrough a plurality of apertures 4 arranged in a matrix manner (refer to FIG. 1B) and is disposed between the upper and lower insulating plates 2 and 3. Between the upper plate or glass plate 2, which is transparent in this embodiment, and the spacer 5, there is disposed an anode 7 which is composed of a plurality of plate-shaped anode elements $A_0$, $A_1$, $A_2$ . . . and $A_n$. In this case, the anode elements $A_0$, $A_1$, $A_2$, . . . and $A_n$ are disposed side by side in opposing relation to the columns of the apertures 4 bored in the spacer 5 is a matrix form. Between the lower plate 3 and the spacer 5, there is disposed a cathode 8 which is composed of a pluarlity of plate-shaped cathode elements $K_0$, $K_1$, . . . and $K_n$. The cathode elements $K_0$, $K_1$, . . . and $K_n$ are disposed side by side in opposing relation to the rows of the apertures 4 bored in the spacer 5. Thus, the cathode elements $K_0$, $K_1$, . . . and $K_n$ cross the anode elements $A_0$, $A_1$, . . . and $A_n$ at right angles thereto, respectively.

After assembling of the above said parts into such a structure as shown in FIG. 1A, their peripheral edges are sealed by means of an adhesive 10 such as frit glass or the like to provide an envelope 1*a*. The envelope 1*a* is evacuated through an exhaust pipe 9*b* and then an inert gas such as neon, xenon, argon, mercury or the like is sealed in the envelope 1*a* through the exhaust pipe 9*b*, thus providing the discharge display device 1. Of course, the exhaust pipe 9*b* is sealed up after sealing of the inert gas in the envelope 1*a*.

With such a construction, application of a voltage between selected ones of the cathode and anode elements $K_0$ . . . and $A_0$ . . . produces a discharge through the aperture 4 of the spacer 5 corresponding to the intersecting point of the selected cathode and anode elements to emit glow light. Accordingly, the apertures 4 formed in the spacer 5 serve as discharge cells.

In this case, the cathode and anode elements have formed therein apertures 8*a* and 7*a* in alignment with those 4 of the spacer 5 so that the discharge can be seen from outside of the envelope 1*a*.

In FIG. 1A, a gas reservoir 9 is mounted on the underside of the lower plate 3 in an airtight manner. The reservoir 9 communicates with the envelope 1*a* through an aperture 9*a* for exhaustion and gas diffusion. Between the reservoir 9 and the outside, the aforesaid exhaust pipe 9*b* is provided. In the envelope 1*a* and the reservoir 9, an inert gas, for example, a neon gas, is filled and, when consumed, it can be supplied through an exhaust pipe 9*b*.

Figure 2A:
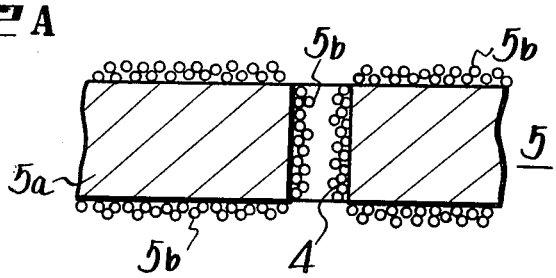
FIG. 2A is a fragmentary cross-sectional view of the discharge promotion member of this invention employed in the discharge display device shown in FIG. 1A.

As illustrated in FIG. 2A, the spacer 5 of this invention is formed as follows. A predetermined conductive or metal plate 5*a* is bored therthough a plurality of apertures 4 by etching treatment, then subjected to washing treatment or the like, covered with, for example, an oxide layer as a coating base, coated with a lower layer (which will be described later), then coated with an upper layer and then subjected to firing treatment to fix the layers to the metal plate 5*a*. Thus, the front and back surfaces including the surface of the apertures 4 are coated with an insulating layer 5*b*. The insulating layer 5*b* is formed porous to permit the passage therethrough of electrons and ions which are produced upon discharge and this layer should not be formed to be a dense layer as of glass or mica. The porous insulating layer 5*b* can be obtained by spraying a chromium oxide or alumina powder material onto the both sides of the conductive metal plate 5*a* together with water glass and then baking the plate 5*a*. In this case, the insulating layer 5*b* is formed porous for permitting the passage of ions and electrons therethrough, as described above, and also uniform with no clogging. However, if the insulating layer 5*b* is made of the above mentioned material only, the size of the bores in the porous layer 5*b* will be too large. Therefore, in order to reduce the size of the bores and also to increase the adhesive density of the material, the glass powder is coated on the metal plate 5*a* as the upper layer and then baked. The above is an example of making the spacer 5 of this invention.

The insulating layer 5*b* is required to have a heat resistance temperature higher than 450°C and, further, since a local magnetic field sometimes exhibits a particular high intensity during discharging of the discharge display device, the insulating layer 5*b* is required to have a uniform withstand voltage higher than 250 Vac. Therefore, it is preferred to check uniformity of the withstand voltage of the insulating layer 5*b* by measuring it, for example, with a measuring instrument employing a brush electrode. Further, the insulating layer 5*b* must not be concave or convex on the surface and be made of such material (inorganic material) which will not disturb the vaccum in the envelope 1*a*.

In trial manufacture of the discharge display device using the spacer 5 of this invention in which the metal plate 5*a* and the spacer 5 were formed 0.25m/m and 0.4 m/m in thickness, respectively, and the insulating layer 5*b* was formed about 0.07 m/m in thickness, the results of measurement of the withstand voltage of the insulating layer 5*b* with the abovesaid brush measuring instrument and a bar electrode were 10 MΩ and higher than 100 MΩ, respectively.

Figure 2B:
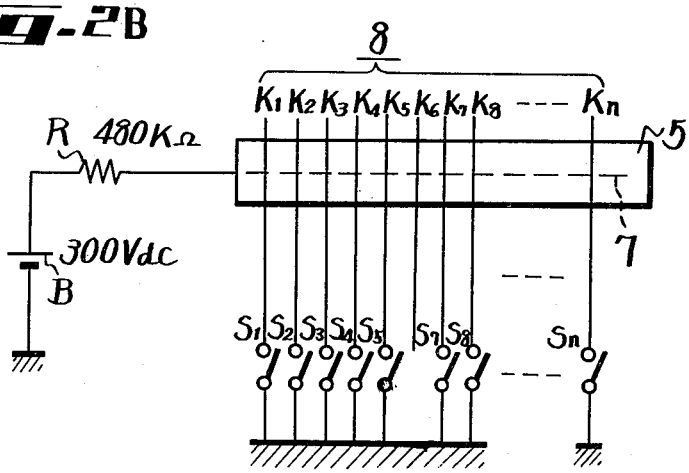
FIG. 2B is a schematic circuit diagram employed in experiment of the materials of the discharge promotion member.

The following will describe the operation of the discharge display device using the spacer 5 of this invention, together with the results of my experiments conducted on the device. FIG. 2B is a schematic wiring diagram of the discharge display device used in my experiments in which a variety of spacers were employed. In FIG. 2B, reference character B indicates an external power source, that is, a battery; R designates a resistor. The anode 7 is supplied with the power source voltage (about 300 $V_{DC}$) through the resistor R having a resistance value of about 480 KΩ. Reference characters $S_1$, $S_2$, . . . and $S_n$ identify switches by means of which the cathode elements $K_1$, $K_2$, . . . and $K_n$ respectively connected thereto through the spacer 5 of this invention are grounded relative to the anode 7. In my experiments, the switches $S_1$, $S_2$, . . . and $S_n$ are adapted to be turned on one after another starting with the switch $S_1$, for example, at regular time intervals of 100 μsec (micro seconds) in such a manner that turning-off of a preceding switch is immediately followed by turning-on of the next. As is apparent from FIG. 2B, no switch is connected to the cathode element $K_6$. Consequently, switching from the switch $S_5$ to $S_7$ is achieved directly at the time interval of 100 μse. Further selective discharge between the anode 7 and the cathode 8 is produced though the aperture 4 shown in FIG. 1B, as mentioned above.

Figure 3A:
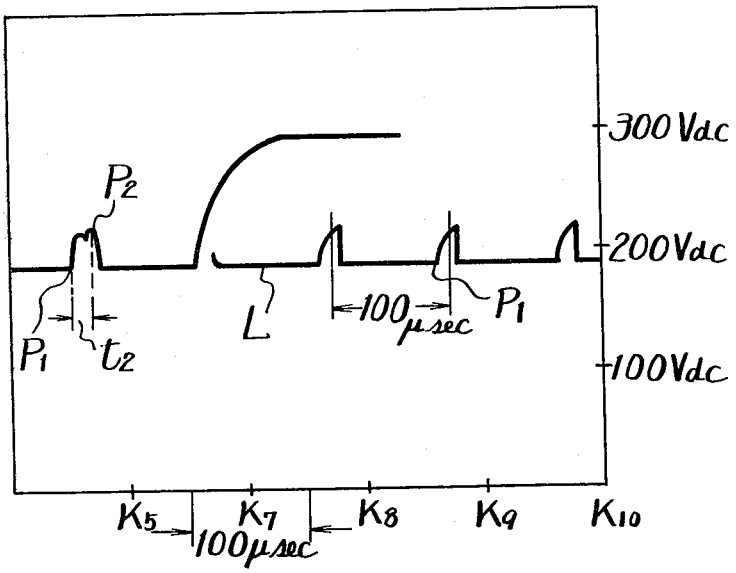
FIGS. 3A and 3B are graphs showing the discharging states in the cases of using various the materials of the discharge promotion member, respectively.
Figure 3B:
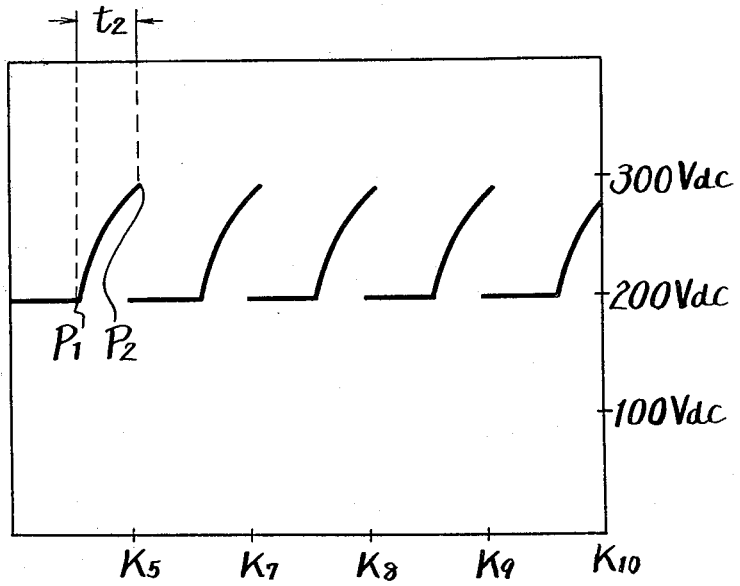

FIGS. 3A and 3B are graphs showing the results of the experiments using various spacers in the discharge display device. FIGS. 3A, and 3B respectively show the discharging conditions of a device employing as the spacer 5, a spacer merely formed of a glass plate and a device employing a spacer having a porous insulating layer deposited on a metal plate, that is, the spacer according to this invention. In FIGS. 3A and 3B, reference character $P_1$ indicates instants of turning on of the switch and $P_2$ indicates firing instants. The firing instants each correspond to the highest potential and, at this instant, the potential is lost due to discharging.

FIG. 3A indicates that, in the cathode element $K_7$, there are some occasions when the firing instant $P_2$ is delayed as compared with the others and no discharge is produced. In FIG. 3B, however, the cathode elements effect discharging at substantially equal time intervals and, at this time, the potential of the spacer 5 is 135 $V_{DC}$ and no delay in discharging of the cathode element $K_7$ appears. The reason for the difference in the firing potential between FIGS. 3A and 3B is that, in the experiments, the diameter of the aperture 4 of the spacer 5 was smaller and the thickness of the spacer 5 was larger in the device of FIG. 3B than those used in the device of FIG. 3A, respectively. Accordingly, as is evident from the figures, the time interval $t_2$ to the firing shown in FIG. 3B is long as compared with that shown in FIG. 3A.

As is seen from FIG. 3B, it may be considered that in the case of using the spacer of this invention, discharging of the cathode element $K_7$ is delayed because it is spaced away from the cathode element $K_5$. In practice, however, even if the spacing of the cathode 8 is large, it is not so much related to the discharge response time and, in my experiment the discharge response time was short and discharge is started positively.

The above is the experimental results, which will be theorized with reference to FIGS. 4 to 8. Generally, the response speed is dependent upon surroundings which determine the speed of electrons in the direction of the arrow *a* which are generated during discharging, that is, the conditions in the envelope 1*a*. Of the surroundings, the effect of the spacer will hereinafter be further described.

Figure 4:
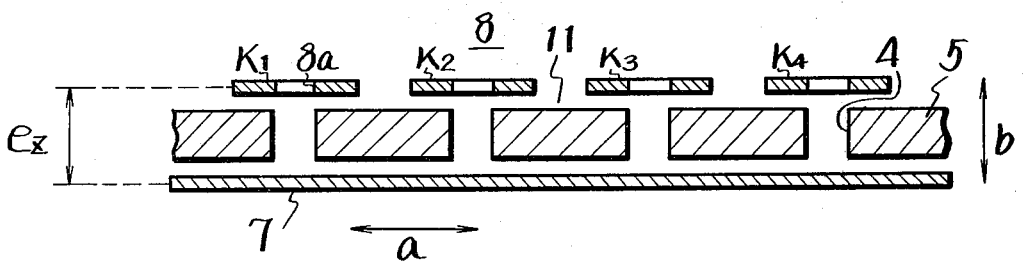
FIG. 4 is a cross-sectional view of the principal part of the discharge promotion member employed in a discharge display device, for explaining it.
Figure 5:
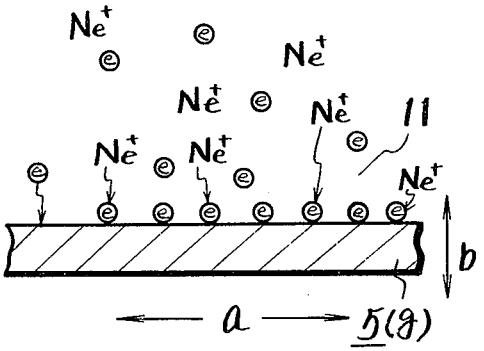
FIGS. 5 to 8 are schematic fragmentary diagrams, for explaining the discharging states in the cases of employing various spacers discharge promotion members.
Figure 6:
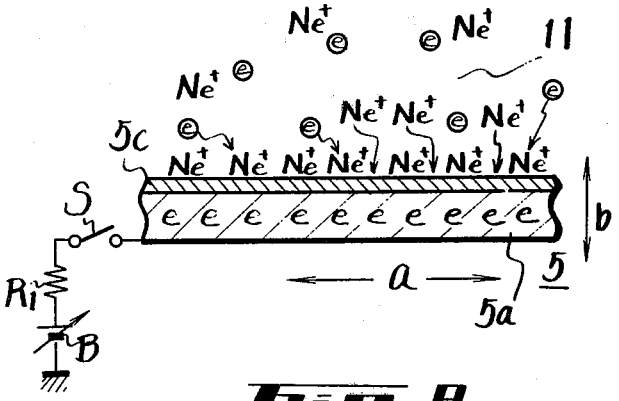
Figure 7:
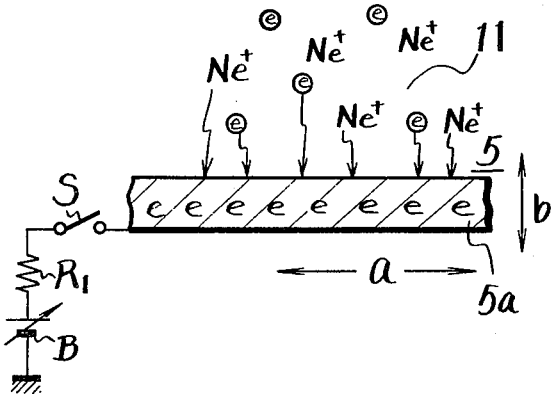
Figure 8:
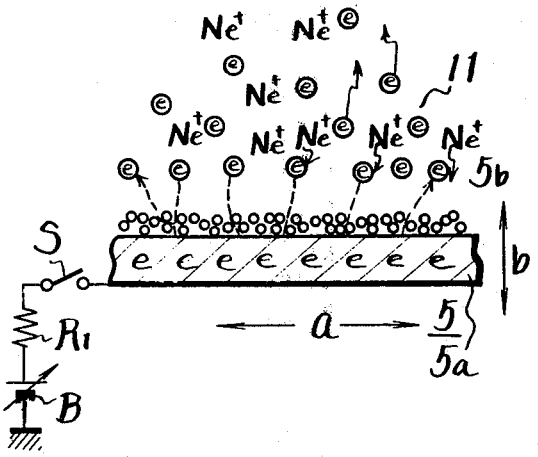

FIG. 4 is a fragmentary cross-sectional view showing the relationship between the anode 7 and the cathode 8 of a discharge tube. FIG. 5 is a cross-sectional view of the spacer 5 in which the spacer 5 is formed of a glass material *g*. FIG. 6 is a cross-sectional view the spacer 5 in which a dense insulating layer 5*c* is deposited on a conductor, that is, the metal plate 5*a* and the metal plate 5*a* is adapted to be supplied with a voltage from a battery B through a resistor $R_1$ and a switch S. FIG. 7 is a cross-sectional view of the spacer 5 in which the insulating layer 5*c* on the metal plate 5*a* in FIG. 6 is removed. FIG. 8 is a cross-sectional view of the spacer 5 of this invention in which the insulating layer 5*c* in FIG. 6 is replaced with the insulating porous layer 5*b*. These figures are explanatory of the acting conditions of electrons *e* and neon ions $Ne^+$ during discharge. Reference numeral 11 identifies a plasma space in the discharge tube.

In the plasma space 11, during discharge, charged particles are diffused and recombined with one another to be extinguished. The charged particles do not have much affect on the other cathode elements spaced away from the cathode element discharged. Since the ions are especially large in size as compared with the electrons, they exhibit a strong tendency to not affect discharge of the other cathode elements. The electrons *e* exert a greater influence on the formation of a neighboring discharge as compared with the ions, as described previously.

Further, in the case of FIG. 7, when no voltage is applied, electrons decrease as is the case with FIG. 5. Upon application of a voltage, electrons *e* jump into a free electron layer on the conductor 5*a* more rapidly and ions are combined with free electrons, so that the same results are obtained.

In this case, by lowering the potential of the conductor 5*a* to the ground potential, electrons *e* is prevented from jumping into the conductor 5*a*, and consequently the amount of electrons *e* in the space 11 is increased, whereby the response time can be hastened. This results in discharging between the anode 7 and the space 5, which implies that the spacer 5 serves as a cathode.

In FIG. 8 employing the spacer 5 of the present invention, the following assumption is probable. Namely, during discharging, electrons *e* generated in the plasma space 11 enter into the porous insulating layer 5*b* to lower its potential as compared with the conductor 5*a*. As a result of this, due to the intensity difference of the electric field, the electrons go into the conductor 5*a* and propagate therein and, at the next discharging electrode position, they go out of the conductor 5*a* due to the electric field established between the anode 7 and the conductor 5*a*. However, these electrons of low energy remain in the insulating layer 5*b* or on its surface and prevent movement of other electrons from entering into the conductor 5*a* from the plasma space 11 through the insulating layer 5*b*, and repel and direct them in the direction *a*, thus facilitating discharge of the next cathode element.

The following table shows the experimental values obtained with the spacers described above.

Table

| No. | Materials of trial manufacture(spacer) | Measured Results: Distance between $K_1$ $K_2$(mm) | Delay of discharge time interval ($t_2$) of $K_2$ ($\mu$sec.) |
|---|---|---|---|
| 1 | Insulating material | 2.54 | 30 – 100 |
| | (the case of FIG. 5) | 7.5 | longer than 100 |
| 2 | Dense insulating material deposited on conductor | 2.54 | 30 – 100 |
| | (the case of FIG. 6) | 7.5 | 30 – 100 |
| 3 | Conductor | 2.54 | longer than 100 |
| | (the case of FIG. 7, +100V applied to | 2.54 | 80 |
| | conductor through resistor of 300KΩ) | 2.54 | longer than 100 |
| 4 | Metal spacer of this invention | 100 | 20 |
| | (the case of FIG. 8, +160V applied | 100 | 40 |
| | to metal plate through resistor of 300 KΩ) | 7.5 | longer than 100 |

Accordingly, in FIG. 4, the spacing between the anode 7 and the cathode 8 in the direction *b* is dependent upon a voltage $e_z$ therebetween during discharge. In fact, the magnetude of the voltage $e_z$ is related to discharge of the next cathode element, but the speed of the electrons in the direction *a* perpendicular to the direction *b* has an important relation to the discharge of the next cathode element. That is, the start of the discharge of the next cathode element is speedy.

By the way, in the case of FIG. 5, the electrons *e* produced by discharge readily adhere to the exposed glass surface as shown and attract ions to extinguish them, thus decreasing electrons promoting discharging of the next cathode element in the plasma space 11.

In the case of FIG. 6, neon ions are attracted to adhere to the surface of the insulating layer 5*c* and they are combined with electrons to provide the same results as shown in FIG. 5. Even if a voltage is applied to the metal plate 5*a* from the battery B, the same results are obtained.

As is apparent from the above table, too, when the spacer 5 of the present invention is used, even if the spacing between adjacent ones of the cathode elements is large, the response time interval is short and the discharge is carried out positively.

The discharge conditions shown in FIG. 3B can be understood from the above and the response time interval can be shortened. Accordingly, the discharge display device of this invention can be employed as a plasma display in place of a Braun tube as mentioned previously and the spacer which is used for graphic display and TV picture display can be produced at lower cost and with more accuracy than those formed of glass.

Although the present invention has been described in connection with the spacer interposed between the anode and the cathode in discharge display, the invention is not limited specifically thereto. For example, the inside of the envelope, which defines the plasma space produced by discharge or which is exposed to positive and negative charges, are formed with the material according to this invention that a conductor is deposited with a porous insulating layer, the inside surface of the envelope thus formed acts to shift discharge rapidly.

With the employment of the discharge promotion member, it is no need to use the priming electrodes and isotopes in the discharge display tube.

It will be apparent that many modifications and variations may be effected without departing from the scope of the novel concepts of this invention.

I claim as my invention:

1. A discharge promotion member for discharge display device having spaced anodes and cathodes mounted within an envelope comprising:

a conductor plate mounted between said anodes and cathodes;

a plurality of apertures bored through said conductor plate;

an insulating layer formed on the surface of said conductor plate;

said insulating layer being porous to electrons and ions, and an ionizing gas within said envelope so that the conductor plate with said insulating layer is located in a plasma space.

2. A discharge promotion member as claimed in claim 1 wherein said porous insulating layer is formed of lower and upper layers which are porous.

3. A discharge promotion member for discharge display device comprising:

a. a conductor plate having bored therethrough a plurality of apertures; and b. an insulating porous layer formed on the surface of said conductive plate, said conductive plate covered with said insulating porous layer being located where it is disposed to a plasma space, in which said insulating porous layer is formed of lower and upper layers, and in which said lower layer is formed of chromium oxide powder and water glass.

4. A discharge promotion member for discharge display device comprising:

a. a conductor plate having bored therethrough a plurality of apertures; and b. an insulating porous layer formed on the surface of said conductive plate, said conductive plate covered with said insulating porous layer being located where it is disposed to a plasma space, in which said insulating porous layer is formed of lower and upper layers and in which said lower layer is formed of alumina powder and water glass.

5. A discharge promotion member for discharge display device comprising:

a. a conductor plate having bored therethrough a plurality of apertures; and b. an insulating porous layer formed on the surface of said conductive plate, said conductive plate covered with said insulating porous being located where it is disposed to a plasma space, in which said insulating porous layer is formed of lower and upper layers and in which said upper layer is made of glass powders.

* * * * *